US010603574B2

(12) United States Patent
Elwin et al.

(10) Patent No.: US 10,603,574 B2
(45) Date of Patent: Mar. 31, 2020

(54) SELF-ADJUSTING DIFFICULTY FEATURE FOR AN AMUSEMENT GAME DEVICE

(71) Applicant: Stern Pinball, Inc., Elk Grove Village, IL (US)

(72) Inventors: Keith Elwin, Park Ridge, IL (US); Mark Guidarelli, Sherman Oaks, CA (US)

(73) Assignee: Stern Pinball, Inc., Elk Grove Village, IL (US)

( * ) Notice: Subject to any disclaimer, the term of this patent is extended or adjusted under 35 U.S.C. 154(b) by 0 days.

(21) Appl. No.: 15/989,584

(22) Filed: May 25, 2018

(65) Prior Publication Data

US 2019/0358520 A1 Nov. 28, 2019

(51) Int. Cl.
*A63F 7/02* (2006.01)
*A63F 11/00* (2006.01)

(52) U.S. Cl.
CPC ..... *A63F 7/027* (2013.01); *A63F 11/0074* (2013.01)

(58) Field of Classification Search
CPC ..... A63F 7/027; A63F 11/0074
See application file for complete search history.

(56) References Cited

U.S. PATENT DOCUMENTS 5,002,279 A * 3/1991 Kaminkow ..... A63F 7/027 273/119 A
5,707,059 A * 1/1998 Sullivan ..... A63F 7/027 273/118 A
2010/0072699 A1 3/2010 Bress et al.
2015/0298003 A1* 10/2015 McMain ..... A63F 13/49 463/24

* cited by examiner

*Primary Examiner* — Jeffrey S Vanderveen
(74) *Attorney, Agent, or Firm* — Greenberg Traurig, LLP

(57) ABSTRACT

A method of determining duration of a play session is described herein using a ball saver. An elapsed game time is tracked and a current round of play identified. Using the current round of play and the elapsed game time, a save time is determined. Finally, an autosave for a duration equal to the save time is activated using mechanical stop, flippers, or programmatic solutions.

14 Claims, 4 Drawing Sheets

SELF-ADJUSTING DIFFICULTY FEATURE FOR AN AMUSEMENT GAME DEVICE

FIELD OF THE DISCLOSURE

The present description relates generally to amusement games and more particularly to a method for self-adjusting difficulty to ensure a desired playtime of an amusement game device.

BACKGROUND

Amusement game devices, such as pinball machines, redemption games, etc. of the commercial, e.g., revenue generating, and non-commercial, e.g., home entertainment, type are well known in the art. By way of example, U.S. Pat. No. 5,707,059 and U.S. Published Application No. 2010/0072699 illustrate and describe amusement game devices of the type having a cabinet which houses a playfield.

U.S. Pat. No. 5,707,059 describes a pinball game provided with a control system which enables a game player to choose between a novice mode of play and a normal mode of play. Specifically, in novice mode, game play proceeds for a predetermined time, regardless of the number of game balls played and selected game features, such as the tilt sensor, may be disabled. In use, the player has the option to choose between modes of play and to learn the game at his or her own pace.

U.S. Published Application No. 2010/0072699 shows a self-adjusting-difficulty feature for a pinball machine. Specifically, the difficulty of play, the chance of a ball draining and staying on the playfield, is adjusted through moving active features such as posts to different positions on the playfield. In use, the method enables operators to set a desired game playtime.

While the ball saving mechanisms, such as described above, generally work for their intended purpose, there is an identifiable desire for improvements to seamlessly improve the game experience for a variety of player skill levels. For instance, the present invention provides for a ball save assembly that provides for a controlled experience in which a ball is played for some minimum amount of time to ensure the player's session is not a negative experience for being unduly short.

SUMMARY

The following describes an improved scalable ball saving mechanism for an amusement game.

A method of determining duration of a play session using a ball saver is disclosed herein. Initially, an elapsed game time is tracked subsequently identifying a current round of play. Using the current round of play and the elapsed game time, a save time is determined. Finally, an autosave for a duration equal to the calculated save time is activated.

A method of managing a play session using a ball saver is disclosed herein. An ideal game time is determined prior to the initiation of play. A game timer is initiated to track an elapsed game time when the first ball is launched to begin an initial turn. An autosave is activated for an initial amount of time. After completing the initial turn, a subsequent ball is launched to begin a subsequent turn. The autosave is activated for a second amount of time determined by the elapsed game time. After completing the second turn, a final ball is launched to begin a final turn. The autosave is activated for a final amount of time determined by the elapsed game time. To conclude, the final turn is completed.

A better understanding of the objects, advantages, features, properties and relationships of the self-adjusting difficulty feature will be obtained from the following detailed description and accompanying drawings which set forth illustrative examples, which are indicative of the various ways in which the principles of the self-adjusting difficulty feature may be employed.

BRIEF DESCRIPTION OF THE DRAWINGS

For a better understanding of the ball saving mechanism disclosed hereinafter reference may be had to the following drawings.

DETAILED DESCRIPTION

The following description of example methods and apparatus is not intended to limit the scope of the description to the precise form or forms detailed herein. Instead the following description is intended to be illustrative so that others may follow its teachings.

With reference to the figures, an amusement game device, in the example form of a pinball machine 10 is now described. It is to be appreciated, however, that this example form for the amusement game device is not intended to be limiting. Rather, those of ordinary skill in the art will appreciate that the ball saving mechanism disclosed hereinafter can be utilized in any type of amusement game device of the commercial and non-commercial type in which it is desired provide a scalable timed experience for a variety of skill levels.

Figure 1:
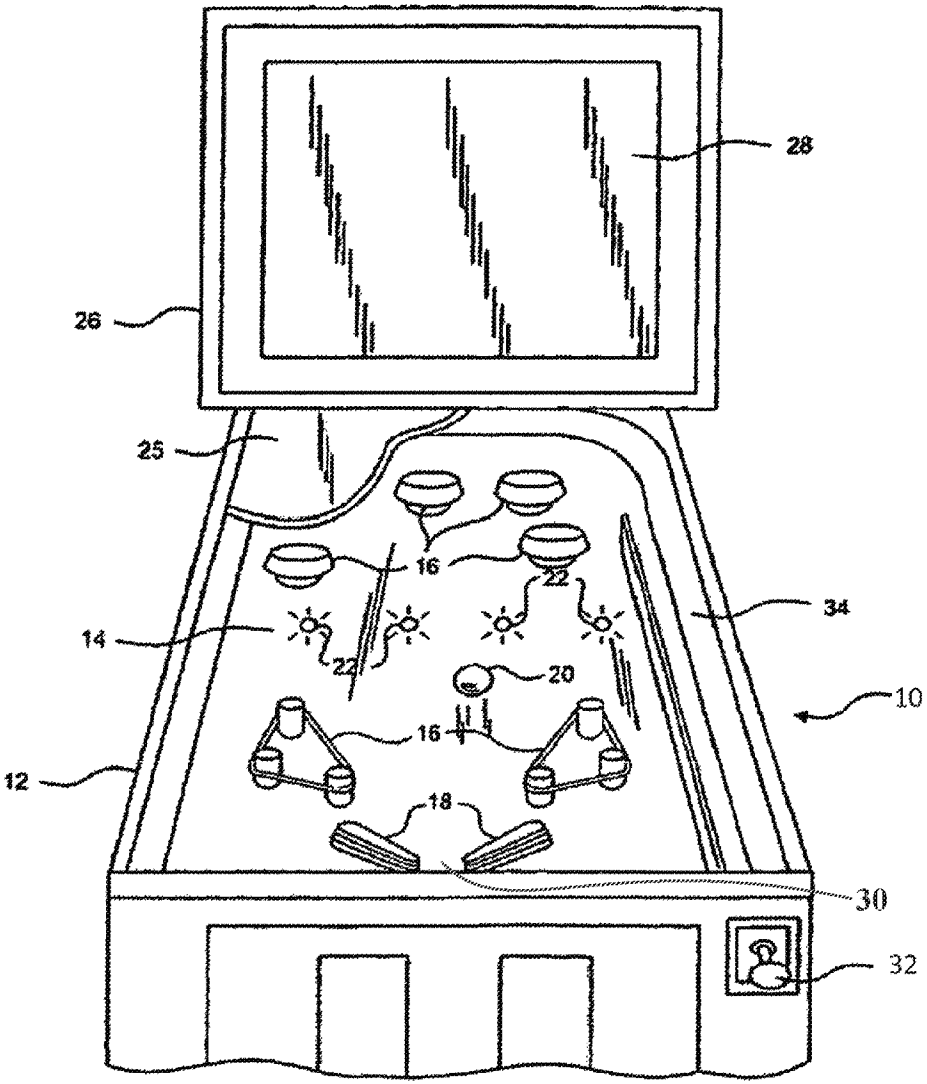
FIG. 1 illustrates an example amusement game device in the form of a pinball machine.

The example pinball machine 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. Upon activation of the game in this manner, game play, in the case of the example pinball machine 10, is defined upon an inclined playfield 14 that supports a number of playfield accessories or devices.

More particularly, in the case of the example pinball machine 10, game play is generally defined through the use of a pair of flippers 18 to propel a ball 20 relative to an upperside (e.g., a first surface) of the playfield 14 and input devices/accessories associated with the playfield 14. The playfield 14 is usually inclined from the horizontal such that the ball tends to eventually roll back down the playfield 14 in the direction of the flippers 18. While not intended to be limiting, the playfield accessories or input devices may include elements such as bumpers 16, ramps, rollover switches 22 and/or other suitable elements as will be appreciated by one of ordinary skill in the art.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of any of the input devices/accessories—and/or other features as desired. Other player-activated input elements, typically in the form of push-buttons (not shown) on the sides of the cabinet 12, are usually provided for controlling operation of the flippers 18. The amusement game 10 may also include a backbox 26 which is mounted to overlay a top rear portion of the cabinet 12 and which contains a game display 28, such as a dot matrix display, CRT, LED or plasma display, or the like. The backbox 26 may also support speakers associated with the game sound system. Within the backbox 26 may be located various ones of the electronic devices/circuits for controlling the operation of the playfield 14, the display 28, general illumination, and the sound system. Such electronic devices/circuits could also, in whole or in part, be carried within the game cabinet 12.

In an example game session, a player of the example pinball machine 10 may pay for a series of rounds of play or "balls" typically defined the launching of the pinballs to begin each round. Each round of play continues as the player uses the features of the playfield 14 and in particular the flippers 18 to keep the ball from entering a drain 30. Typically, when the ball enters the drain 30 the round ends. As described herein, a number of methods may be used to extend the round or keep the ball on the playfield 14 to prevent the round from ending.

Figure 2:
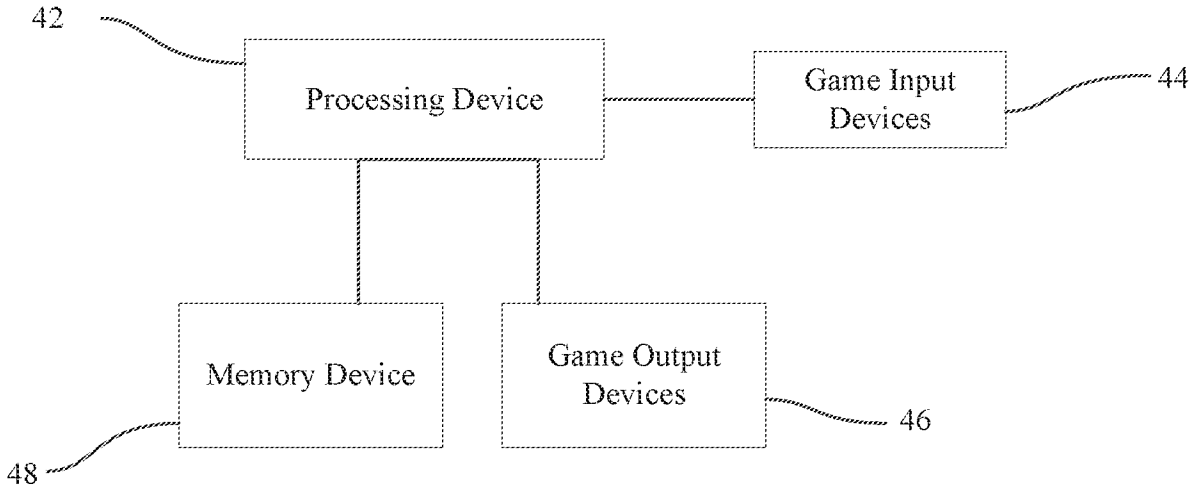
FIG. 2 is an example block diagram of example components of the amusement game device of FIG. 1.

Referring to FIG. 2, for controlling the various devices that form the amusement game, the example pinball machine 10 is provided with a processing device 42 which processing device 42 is, in turn, coupled to game input devices 44, such as switches associated with the cabinet 12, playfield 14 (including the target assemblies 24), etc., and game output devices 46, such as lights (including lights associated with target assemblies 24), bumpers 16, flippers 18, display 28, etc. via one or more buss systems. A memory device 48, such as a RAM, ROM, or the like, stores instructions and data usable by the processing device 42 to control play of the game, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3:
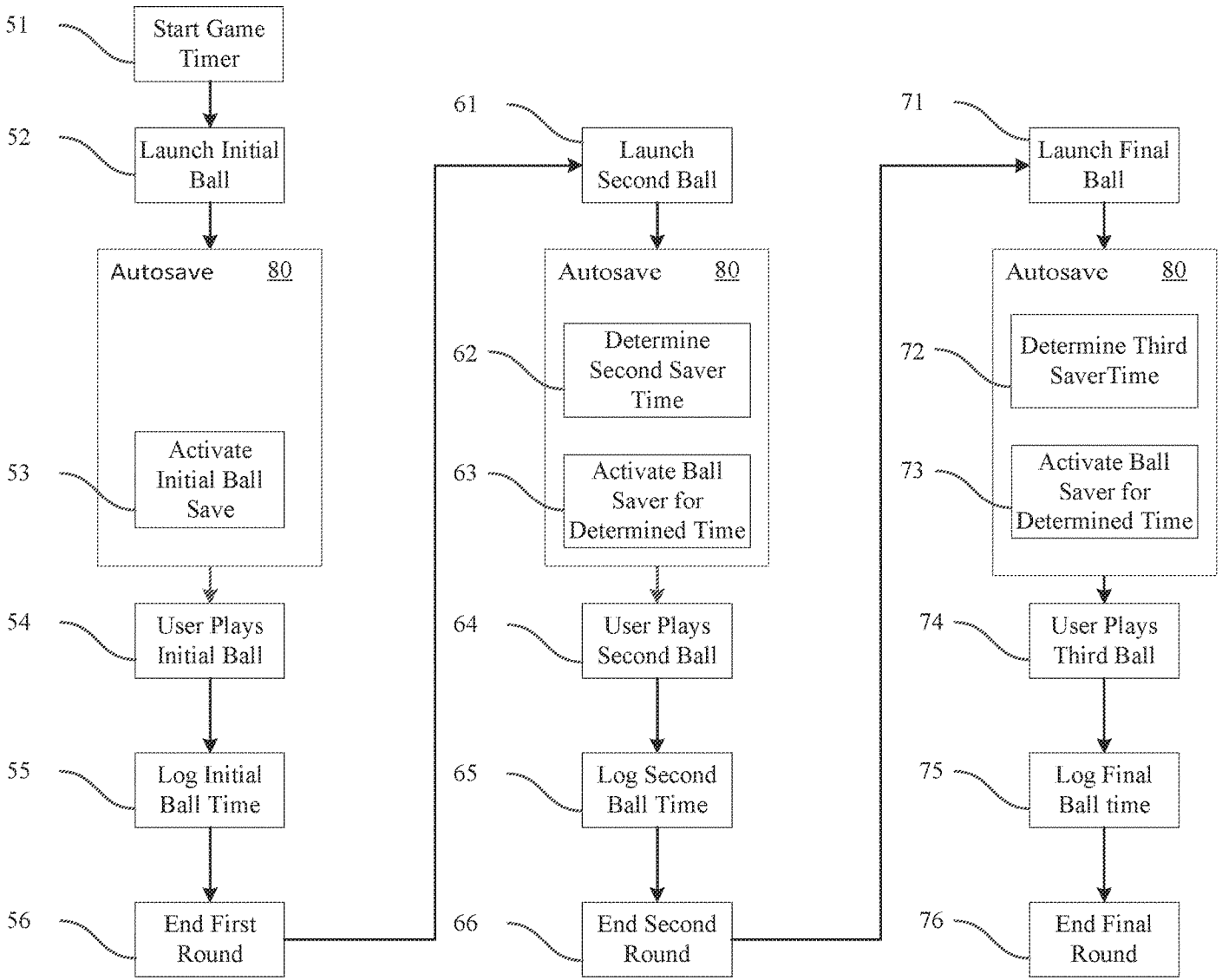
FIG. 3 shows a diagrammatic view of a play session utilizing the autosave features according to the teachings of the present disclosure.

Turning now to FIG. 3, a diagram of a series of stages of a single play session is shown. In this example, three rounds are shown with three balls launched as described below at blocks 51, 61, and 71. Throughout the rounds of the play session, a persistent game timer is running. This game timer measures the amount of time that has passed since the user began the play session. The timer is started at block 50 just before the first ball is launched at block 52.

After block 52, the ball saver or autosave feature is initiated. A ball saver or autosave prevents the round from ending too early. This can be accomplished through movable bumpers 16 or mechanical stops which block the ball from leaving the playfield 14 or flippers 18 which bounce the ball back into play. In other cases, this is accomplished via software and a new ball is launched to continue the round. These features can serve to prevent a round from being so short that the user is left dissatisfied. They also may allow a new user to learn the game and its timings by forgiving early mistakes.

An autosave 80 or ball saving feature takes effect after the ball is launched. Within the autosave 80, a default ball save can be set. At block 53, an initial ball save time is set for the initial ball. This could be set universally for all rounds of a play session, or it could be chosen by a site administrator. The initial ball save time might be a default only for the initial round and varied for the later rounds. When the initial ball save has elapsed, the autosave is ceased and the ball is no longer prevented via hardware or software from being lost.

At block 54, the round continues until the ball is lost down the drain 30 by the player. At block 55, the elapsed game time at the loss of the initial ball is recorded and, at block 56, the first round is ended. In the example shown, the elapsed game time may be recorded by a processing device 42 using a memory device 48. The elapsed game time can be used to time the length of any single round or turn as well as an ongoing timer for the entire session of a single user.

An intermediate iteration of play is started at block 61. In the example shown in FIG. 3, there are three rounds. However, in other examples, the user can play more than three rounds. This may be by a change in initial conditions (i.e. all players start with four balls to play) or additional rounds may be given to a player as a form of reward (i.e. contacting a specific combination of bumpers with the ball).

After play is resumed at the beginning of the round at block 61, the autosave 80 is executed by the processing device 42 immediately after the turn is begun. The autosave 80 must determine the length of time to maintain the ball saver at block 62. Subsequently, the autosave 80 activates the ball saver for that much time at block 63. One method of computing that save time is shown and discussed below with regard to FIG. 4. The user then plays the intermediate ball at block 64. After the autosave 80 is complete, the user's second round will end when the ball goes down the drain 30. At this point, the game time is stored at block 65, and the intermediate round ends at block 67.

A third iteration of play is started at block 71. The autosave 80 is again executed by the processing device 42 immediately after the turn is begun at block 71. The autosave 80 must determine the length of time to maintain the ball saver at block 72. Subsequently, the autosave 80 activates the ball saver for that much time at block 73. One method of computing that autosave duration or save time is shown and discussed below with regard to FIG. 4. The user then plays the final ball at block 74. After the autosave 80 is complete, the user's second round will end when the ball goes down the drain 30. At this point, the game time is stored at block 75, and the final round ends at block 77.

Figure 4:
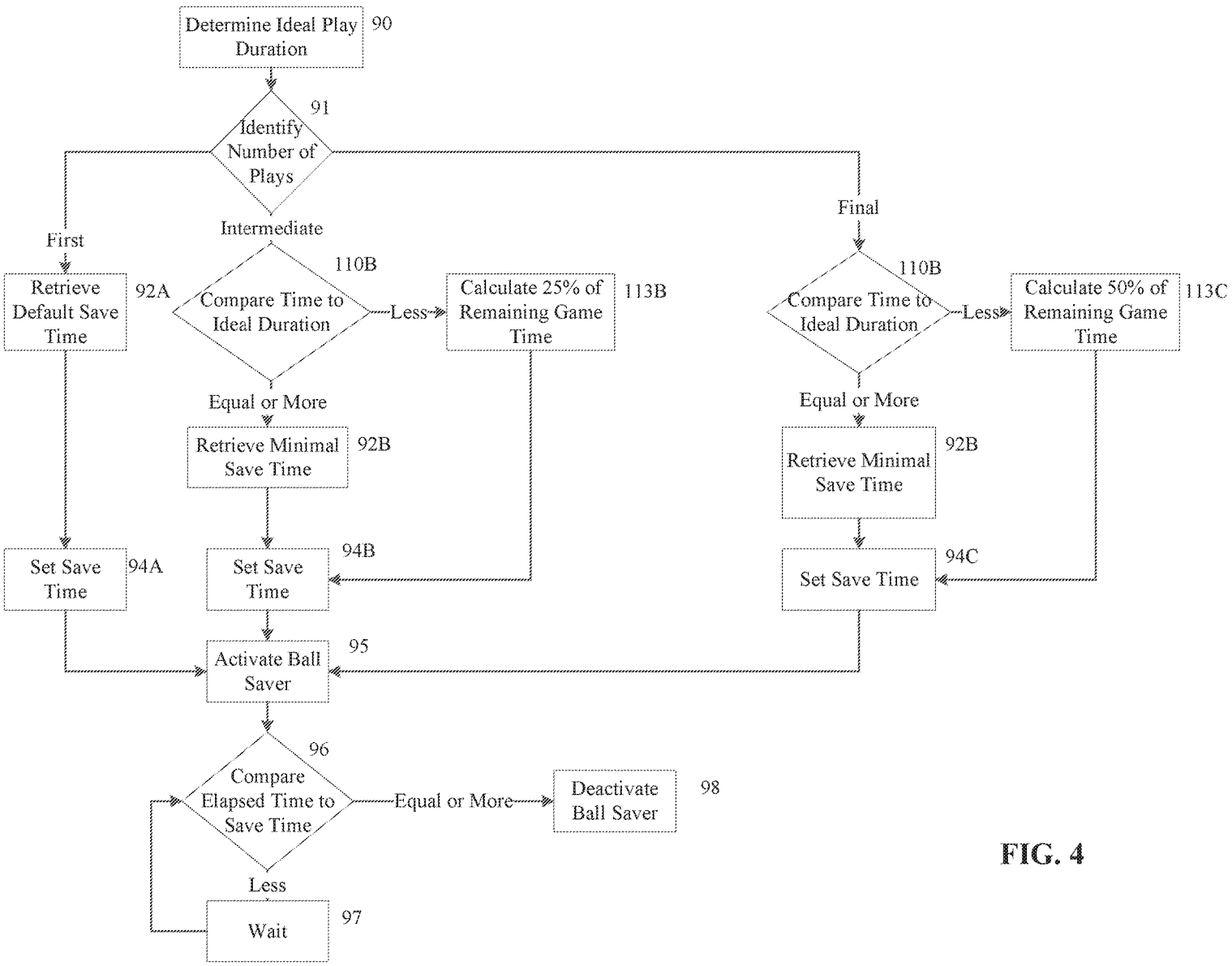
FIG. 4 is a flowchart of the autosave duration feature according to one example of the teachings of the present disclosure.

Referring now to FIG. 4, one example method is disclosed for determining appropriate save time within the autosave 80 in relation to a desired game time. The desired game time is an ideal game time to allow each player to feel that a play is satisfactory. The desired game time may be encoded into the machine at block 90, by a call for the autosave 80 to execute a ball saving mechanism. At block 91, a preliminary evaluation is made as to the position in which the game is when the autosave is called.

From the decision at block 91, a first turn retrieves a default game save time. In the example shown, the default save time is five seconds. In other examples, the default save time is determined by a set portion of a desired game time, such as ten percent of the desired game time. At block 94A, the retrieved default save time is set to be the save duration.

At block 95, the processing device activates the physical components of the autosave 80 to execute the deployable ball saving mechanism. A timer is initiated which begins tracking an elapsed time. At block 96, the elapsed time is compared to the determined save duration. If the time is less than the determined save duration, the elapsed time is incremented at block 97. Further, at block 97, the system waits with the autosave 80 operational while the user plays. If the determination at block 96 is equal to or more than the save duration, the ball saver is deactivated at block 98 and the autosave 80 is complete.

In other examples, the activation and deactivation of the autosave is done via software. In such an example, the autosave may award a ball to the player to replace a ball that entered the drain 30 during the autosave period. A series of lights or other visual indicators may be used to indicate to the user that the autosave is operational in this case.

In this example, a first turn is evaluated in a different way than an intermediate or final turn. However, in some examples each turn or round of play is evaluated in the same way. For example, each autosave duration could represent a third of the remaining game time. In yet further examples, the methods of the intermediate rounds described above could be applied to all the rounds.

Returning to the decision at block 91, an intermediate round proceeds to block 110B. An intermediate round is any ball played that is neither the first nor the last ball to be played. In the example shown, this includes only initial plays, not additional balls earned through features of the playfield 14 or a specific combination of target assemblies 34.

At block 110B, the current elapsed game time, the time between the current moment of play and the beginning of play, is compared to the ideal or desired game time. If the elapsed game time is less than the desired game time, a percentage of the remaining game time is computed at block 113B. The remaining game time is the difference between the desired game time and elapsed game time. In the example shown, this percentage is twenty-five percent of the remaining game time. The percentage of the remaining game time is set as the save duration at block 94B.

If the comparison of the current elapsed game time to the ideal or desired game time at block 110B is equal or more than that a minimal save time is retrieved. In this example, the minimal save time is the same as the initial default save time which is ten percent of the desired game time. In other examples, the minimal save time is zero, so, for example, the autosave is not activated at all if the desired game time has been achieved. The autosave is activated for the intermediate round at blocks 96-98 as discussed above.

Again returning to the decision at block 91, a final round proceeds to block 110C. At block 110C, the current elapsed game time is compared to the ideal or desired game time. If the elapsed game time is less than the desired game time, a percentage of the remaining game time is computed at block 113C. The remaining game time is the difference between the desired game time and elapsed game time. In the example shown, this percentage is twenty-five percent of the remaining game time. The percentage of the remaining game time is set as the save duration at block 94B. The autosave is activated at blocks 96-98 as discussed above.

If the comparison of the current elapsed game time to the ideal or desired game time at block 110C is equal or more than that a minimal save time is retrieved. The minimal save time could be the same as the initial default save time which, in this example, is ten percent of the desired game time. In other examples, the minimal save time is zero, so the autosave is not activated if the desired game time has been achieved. The autosave is activated for the final round at blocks 96-98 as discussed above.

The example autosave demonstrates a system in which a beginner and an expert are allowed to play the same field using the same rules. Using this system, the experience of the beginner is prolonged so as to prevent unhappiness with the chosen game. At the same time, the expert is not given an artificially extended experience. This provides an ideal playing experience across the various skill levels with minimal overt interference.

While specific examples of the present invention have been disclosed in detail, it will be appreciated by one of ordinary skill in the art that the various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

We claim:

1. A method of determining duration of a play session on a pinball machine comprising:

initiating a play session on the pinball machine, the play session divided into a plurality of rounds and occurring on a playfield of the pinball machine;

tracking an elapsed game time for the play session;

identifying a current round of play as a first, intermediate, or final round of play, determining a save time based on the current round of play and the elapsed game time; and activating an autosave for a duration equal to the save time at the initiation of the current round of play, wherein for the duration equal to the save time the autosave prevents an ending of the current round of play, wherein determining the save time for an intermediate round or a final round is proportional to the ratio of the difference between an ideal game time and the elapsed game time;

a mechanical stop configured to be moved into the playfield to block a ball from entering a drain.

2. The method of determining duration of a play session of claim 1 wherein a default amount of save time used when the elapsed game time is minimal.

3. The method of determining duration of a play session of claim 1 wherein the portion of the ratio of the difference between the ideal game time and the elapsed game time is a scaled factor relating to the current round of play.

4. The method of determining duration of a play session of claim 1 wherein the portion of the ratio of the difference between the ideal game time and the elapsed game time is 25% for the intermediate turn.

5. The method of determining duration of a play session of claim 1 wherein the portion of the ratio of the difference between the ideal game time and the elapsed game time is 50% for the final turn.

6. The method of determining duration of a play session of claim 1 wherein the autosave further comprises a flipper automatically configured to be engaged in the playfield to block a ball from entering a drain.

7. The method of determining duration of a play session of claim 1 wherein activating the autosave further comprises relaunching a ball without incrementing or ending the current round of play.

8. A method of managing a play session on a pinball machine comprising:

determining an ideal game time of the play session occurring on a playfield of the pinball machine prior to an initiation of play, wherein the play session is divided into a plurality of rounds;

initiating a game timer to track an elapsed game time for the play session;

launching a first ball to begin an initial round;

Notice of Non-Compliant Amendment activating an autosave for an initial amount of time, wherein for the duration equal to the initial amount of time the autosave prevents an ending of the initial turn, monitoring the user's play for a concluding signal, completing the initial round in response to the concluding signal;

launching a subsequent ball to begin a subsequent round;

activating the autosave for a second amount of time determined by the elapsed game time, wherein for the duration equal to the second amount of time the autosave prevents an ending of the subsequent round;

completing the subsequent round in response to the concluding signal;

launching a final ball to begin a final round in response to the concluding signal;

activating the autosave for a final amount of time determined by the elapsed game time, wherein for the duration equal to the final amount of time the autosave prevents an ending of the final round, and completing the final round in response to the concluding signal;

wherein determining the initial, second, or final amount of time for an intermediate round or a final round is proportional to the ratio of the difference between an ideal game time and the elapsed game time;

a mechanical stop configured to be moved into the playfield to block a ball from entering a drain.

9. The method of managing a play session of claim 8 wherein the autosave is activated for a default amount of save time is used when the elapsed game time is minimal.

10. The method of managing a play session of claim 8 wherein the portion of the ratio of the difference between the ideal game time and the elapsed game time is a scaled factor relating to the initial, second, or final round.

11. The method of managing a play session of claim 8 wherein the portion of the ratio of the difference between the ideal game time and the elapsed game time is 25% for the subsequent round.

12. The method of managing a play session of claim 8 wherein the portion of the ratio of the difference between the ideal game time and the elapsed game time is 50% for the final round.

13. The method of managing a play session of claim 8 wherein the autosave further comprises a flipper automatically configured to be engaged in the playfield to block a ball from entering a drain.

14. The method of managing a play session of claim 8 wherein activating the autosave further comprises relaunching a ball without incrementing or ending the initial, second, or final round.

* * * * *